US011743624B2

(12) United States Patent
Ikeda

(10) Patent No.: US 11,743,624 B2
(45) Date of Patent: Aug. 29, 2023

(54) PANEL SPEAKER

(71) Applicant: DENSO TEN Limited, Kobe (JP)

(72) Inventor: Shinichi Ikeda, Kobe (JP)

(73) Assignee: DENSO TEN Limited, Kobe (JP)

( * ) Notice: Subject to any disclaimer, the term of this patent is extended or adjusted under 35 U.S.C. 154(b) by 0 days.

(21) Appl. No.: 17/579,710

(22) Filed: Jan. 20, 2022

(65) Prior Publication Data

US 2023/0056700 A1 Feb. 23, 2023

(30) Foreign Application Priority Data

Aug. 20, 2021 (JP) ..... 2021-134514

(51) Int. Cl.

*H04R 1/02* (2006.01)
*H04R 7/04* (2006.01)
*H04R 17/00* (2006.01)

(52) U.S. Cl.

CPC ..... *H04R 1/028* (2013.01); *H04R 7/04* (2013.01); *H04R 17/00* (2013.01); *H04R 2400/11* (2013.01); *H04R 2499/15* (2013.01)

(58) Field of Classification Search

CPC ..... H04R 1/028; H04R 7/04; H04R 17/00; H04R 2400/11; H04R 2499/15

See application file for complete search history.

(56) References Cited

U.S. PATENT DOCUMENTS 3,728,497 A * 4/1973 Komatsu ..... H04R 9/066 381/419
5,693,917 A * 12/1997 Bertagni ..... H04R 7/04 181/173
8,116,505 B2 * 2/2012 Kawasaki-Hedges ... H04R 5/02 381/388
8,254,623 B2 * 8/2012 Okumura ..... H04R 1/025 381/388
8,571,248 B2 * 10/2013 Li ..... H04R 9/06 381/345
10,252,802 B2 * 4/2019 Cheung ..... H04R 31/00
10,674,271 B2 * 6/2020 Ikeuchi ..... H04R 7/04
11,200,021 B2 * 12/2021 Lee ..... G10K 9/122
2011/0141671 A1 * 6/2011 Ishizu ..... F16M 11/10 361/679.01
2013/0236045 A1 * 9/2013 Wan ..... H04R 1/02 381/392
2014/0198474 A1 * 7/2014 Byeon ..... G02F 1/133308 361/809
2019/0116426 A1 * 4/2019 Bhutani ..... H04R 9/063
2022/0248115 A1 * 8/2022 Tanaka ..... H04R 1/026

FOREIGN PATENT DOCUMENTS

JP 2010-171927 A 8/2010

* cited by examiner

*Primary Examiner* — Oyesola C Ojo
(74) *Attorney, Agent, or Firm* — Oliff PLC

(57) ABSTRACT

A panel speaker includes: a panel; a vibration actuator having first and second oppositely-facing surfaces, the first surface facing the panel; a screw that fastens the vibration actuator to the panel, the screw having a head that protrudes beyond the second surface of the vibration actuator; and a back chassis that faces the second surface of the vibration actuator. The back chassis has a protrusion protruding toward the vibration actuator in a portion of the back chassis that faces the head of the screw.

7 Claims, 3 Drawing Sheets

PANEL SPEAKER

BACKGROUND OF THE INVENTION

Field of the Invention

The invention relates to a panel speaker.

Description of the Background Art

There is a display speaker that uses a display as a speaker by vibrating a display panel of the display using an actuator (vibration actuator) with a piezoelectric element. In the display speaker, the vibration actuator is mounted on a back surface of the display panel (vibration panel). As a result, it is possible to transmit a vibration of the vibration actuator to the display panel.

When an external force is applied to the display panel, the vibration actuator on a back side of the display may come into contact with a back chassis that exists on a back side of the vibration actuator and is a part of components covering the display speaker. There is a problem that the vibration actuator does not vibrate when the vibration actuator is shorted out with the display panel.

SUMMARY OF THE INVENTION

According to one aspect of the invention, a panel speaker includes: a panel; a vibration actuator having first and second oppositely-facing surfaces, the first surface facing the panel; a screw that fastens the vibration actuator to the panel, the screw having a head that protrudes beyond the second surface of the vibration actuator; and a back chassis that faces the second surface of the vibration actuator. The back chassis has a protrusion protruding toward the vibration actuator in a portion of the back chassis that faces the head of the screw.

It is an object of the invention to provide a panel speaker that reduces contact between a vibration actuator and a back chassis.

These and other objects, features, aspects and advantages of the invention will become more apparent from the following detailed description of the invention when taken in conjunction with the accompanying drawings.

DESCRIPTION OF THE EMBODIMENTS

A panel speaker according to an embodiment of the invention will be described below with reference to the drawings. A configuration of the panel speaker according to the embodiment described below is merely an example and this invention is not limited thereto.

Here, an example in which a vibration actuator is provided on a display panel (vibration panel) of a display and the display is functioned as a display speaker will be described. The display speaker is a device that outputs (emits) a sound wave from the display panel by vibrating the display panel using the vibration actuator (actuator). The display speaker is one example of the panel speaker. The panel speaker outputs a sound by vibrating a plane panel, for example, such as a display panel. The display speaker is covered by a back chassis, etc. on a back side of the display speaker.

EMBODIMENT

First Configuration Example

Figure 1:
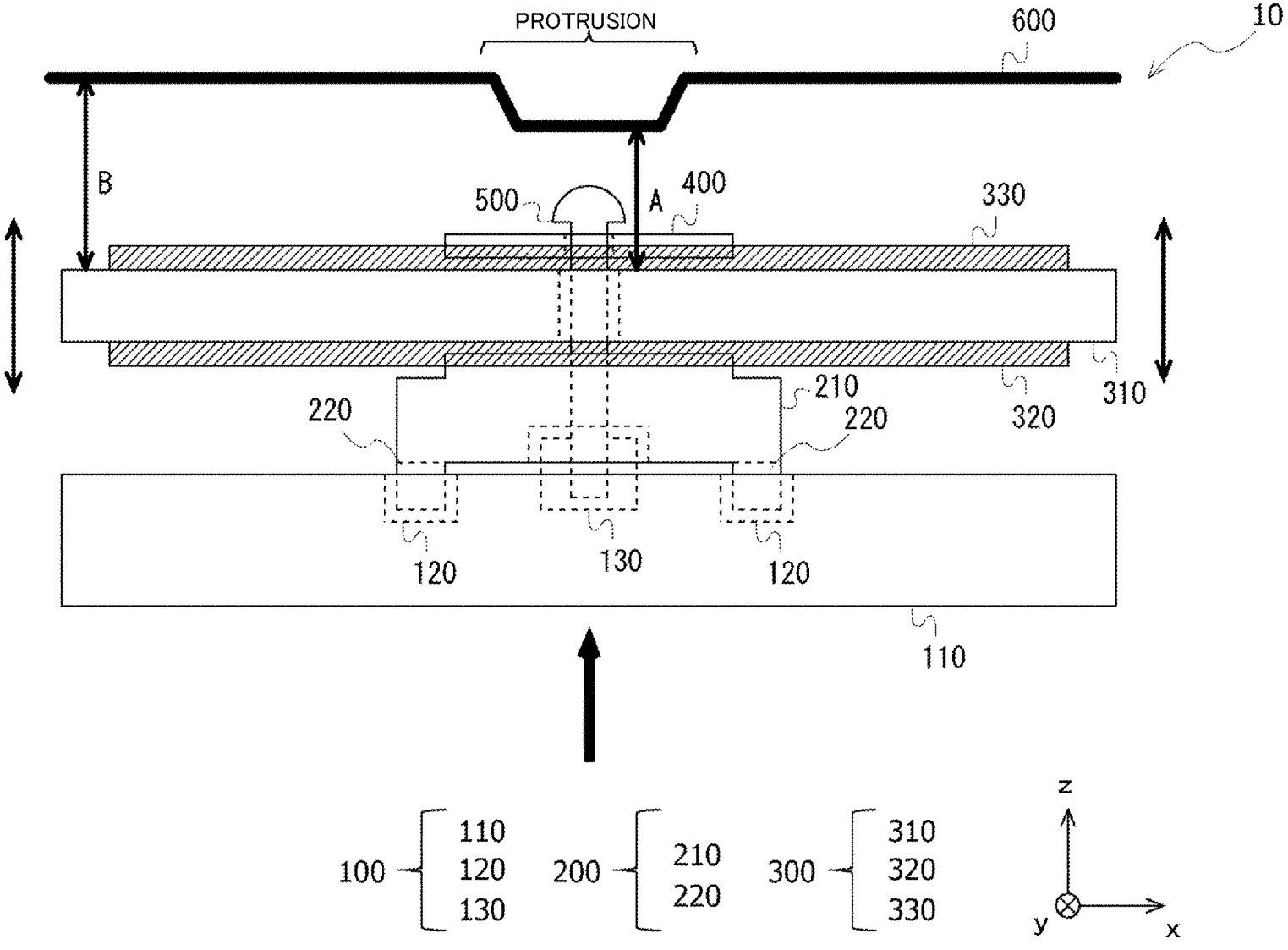
FIG. 1 illustrates a first configuration example of a display speaker 10 according to an embodiment.

FIG. 1 illustrates a first configuration example of a display speaker 10 according to an embodiment. FIG. 1 is a side view when viewed from a side the display speaker 10. The display speaker 10 includes a display panel 100, a bracket 200, a vibration actuator 300, a spacer 400, a screw 500, and a back chassis 600. In the display speaker 10, the display panel 100, the bracket 200, the vibration actuator 300, and the spacer 400 are piled up in this order. The back chassis 600 is supported by the display panel 100, and the like. The back chassis 600 does not come into contact with the screw 500 and the vibration actuator 300 in a normal state (a state in which an external force is not applied to the display panel 100).

The display panel 100 includes a body 110, a bracket mounting portion 120, and a screw fixing portion 130. The bracket 200 includes a body 210 and a leg 220. The vibration actuator 300 includes a diaphragm 310, a piezoelectric element 320 to be attached to a surface (referred to as a first surface) of the diaphragm 310 on a side of the display panel, and a piezoelectric element 330 to be attached to a surface (referred to as a second surface) opposite to the first surface of the diaphragm 310. In the display speaker 10, the display panel 100, the bracket 200, the vibration actuator 300, and the spacer 400 are arranged in this order and are fixed by the screw 500. A plurality of brackets 200, vibration actuators 300, spacers 400, and screws 500 may be mounted to one display panel 100. Here, a left-right direction in FIG. 1 is referred to as an x direction, a direction from a front surface to a back surface of a paper in FIG. 1 is referred to as a y direction, a direction from a bottom to a top (a direction from the display panel 100 to the vibration actuator 300) in FIG. 1 is referred to as a z direction. A positional relation between the display speaker 10 and the x, y, and z directions is the same in other drawings. The screw 500 is attached in parallel to the z direction. The display panel 100 is one example of the panel.

The display panel 100 is made of a conductive metal and is grounded. The body 110 is a plate member to be a diaphragm of the display speaker 10. The bracket mounting portion 120 is a recess in which the leg 220 of the bracket 200 is received. A shape of the bracket mounting portion 120 is a hole conforming to a shape of the leg 220 of the bracket 200. The bracket mounting portion 120 into which the leg 220 of the bracket 200 is fitted prevents the bracket 200 from rotating in the z direction. The bracket mounting portion 120 is recessed from a plane of the body 110 on a side of the vibration actuator 300 to a side opposite to the side of the vibration actuator 300. The screw fixing portion 130 is a fixed axis for fixing the screw 500. The screw fixing portion 130 has a screw hole for fixing the screw 500. The screw 500 is fixed by the screw fixing portion 130 in parallel to the z direction. The screw fixing portion 130 extrudes from the plane of the body 110 on the side of the vibration actuator 300 to the vibration actuator 300. The screw fixing portion 130 may not extrude from the plane of the body 110 on the side of the vibration actuator 300. The display panel 100 is a display panel, such as a liquid crystal display panel, an organic EL (Electro-Luminescence) display pane, or the like.

The bracket 200 includes the body 210 and the leg 220. The bracket 200 transmits a vibration of the vibration actuator 300 to the display panel 100. The bracket 200 is an insulator. The bracket 200 is, for example, made of resin. The body 210 of the bracket 200 is, for example, a columnar object and has an upper surface and a lower surface that are substantially parallel to each other. The upper surface comes into contact with the vibration actuator 300 and the lower surface comes into contact with the display panel 100. A shape of the upper surface may be different from a shape of the lower surface. The body 210 has a through-hole through which the screw 500 is passed between the upper surface and the lower surface. A diameter of the through-hole on the side of the vibration actuator 300 is larger than a diameter of an axis of the screw 500. A diameter of the through-hole on the side of the display panel 100 is larger than an outer diameter of the screw fixing portion 130 of the display panel 100. The leg 220 extends from the lower surface of the body 210 to the display panel 100. The leg 220 has a shape that is fitted into the bracket mounting portion 120 of the display panel 100. The leg 220 has, for example, a columnar shape, such as a cylinder, a square prism, or the like. The diaphragm 310 of the vibration actuator 300 is connected to the display panel 100 via the bracket 200. The shape of the upper surface of the body 210 is, for example, a rectangular shape.

The diaphragm 310 of the vibration actuator 300 is a rectangular plate member and has a front surface (a first surface) and a back surface (a second surface) in a direction perpendicular to a thickness direction of the diaphragm 310. A shape of the diaphragm 310 in a plan view may be a round or oval shape. The diaphragm 310 may have other shapes as long as the diaphragm 310 is vertically and laterally symmetrical. The front surface is substantially parallel to the back surface. A central portion (portion including a center of the first surface, the central portion in a plan view) of the diaphragm 310 is exposed from an opening of the piezoelectric element 320. Here, when the shape of the diaphragm 310 is a rectangular shape, the center of the first surface (the second surface) of the diaphragm 310 is an intersection of two diagonal lines of the rectangular shape. When the shape of the diaphragm 310 is a round or oval shape, the center of the first surface (the second surface) is a center of the round or oval shape. Even when the diaphragm 310 has other shapes, the center of the first surface (the second surface) of the diaphragm 310 may be defined, for example, by a center of gravity. The diaphragm 310 is a conductor (e.g., metal). The diaphragm 310 is arranged so that the front surface of the diaphragm 310 is substantially parallel to a back surface of the display panel 100.

When a voltage is applied, the piezoelectric elements 320, 330 are deformed according to the voltage. The piezoelectric elements 320, 330 are made of a plate material, such as a ceramic, showing piezoelectric effects. An electrode for applying the voltage is attached to each of the piezoelectric elements 320, 330. The piezoelectric element 320 is attached to the first surface of the diaphragm 310. The piezoelectric element 330 is attached to the second surface of the diaphragm 310. Since the diaphragm 310 is a conductor, the diaphragm 310 becomes one electrode of the piezoelectric element 320 and becomes one electrode of the piezoelectric element 330. The piezoelectric element 320 has an opening so that the central portion of the diaphragm 310 is exposed when viewed from a side of the first surface. In the central portion of the diaphragm 310, a through-hole through which the screw 500 is passed exists. The diameter of the through-hole is larger than the diameter of the axis of the screw 500 so that the diaphragm 310 does not come into contact with the screw 500. Since the screw 500 and the diaphragm do not come into contact with each other, the diaphragm 310 is not electrically short-circuited (shorted out) with the display panel 100. That is, the display panel 100 is electrically insulated from the diaphragm 310. The diaphragm 310 has a portion that is exposed (exposed portion) from the opening of the piezoelectric element 320 in a central portion of the first surface of the diaphragm 310. The upper surface of the body 210 of the bracket 200 comes into contact with the opening of the piezoelectric element 320. The opening of the piezoelectric element 320 is larger than the upper surface of the body 210 of the bracket 200. At this time, the piezoelectric element 320 and the bracket 200 do not come into contact with each other. The piezoelectric element 330 has an opening so that the central portion of the diaphragm 310 is exposed when viewed from a side of the second surface. The diaphragm 310 has a portion that is exposed (exposed portion) from the opening of the piezoelectric element 330 in a central portion of the second surface of the diaphragm 310. A lower surface of the spacer 400 comes into contact with the opening of the piezoelectric element 330. The opening of the piezoelectric element 330 is larger than the lower surface of the spacer 400. At this time, the piezoelectric element 330 and the spacer 400 do not come into contact with each other. The piezoelectric element 330 does not need to be attached to the diaphragm 310. The first surface and the second surface are parallel to an xy plane.

The opening of the piezoelectric element 320 may have a rectangular shape (square shape), or a round or oval shape in accordance with a shape of the bracket 200. In order to increase an area of the piezoelectric element 320, it is desirable that a size of the opening of the piezoelectric element 320 is reduced as much as possible. By increasing the area of the piezoelectric element 320, it is possible to further increase an output (maximum output) of the display speaker 10. When the vibration actuator 300 is viewed from the side of the first surface, it is desirable that both ends of the piezoelectric element 320 are positioned inside both ends of the diaphragm 310. If the both ends of the piezoelectric element 320 are positioned outside the both ends of the diaphragm 310, the piezoelectric element 320 is easily damaged. The same applies to the piezoelectric element 330 to be attached to the second surface of the diaphragm 310.

The spacer 400 is sandwiched between a head of the screw 500 and the diaphragm 310 of the vibration actuator 300. The spacer 400 is an insulator. The spacer is made of resin, for example. A material of the spacer 400 is preferably the same as a material of the bracket 200. An elastic modulus of the spacer 400 is preferably equal to an elastic modulus of the bracket 200. The spacer 400 is, for example, a columnar object and has an upper surface and a lower surface that are substantially parallel to each other. The upper surface of the spacer 400 comes into contact with a lower part of the head of the screw 500 and the lower surface of the spacer 400 comes into contact with the diaphragm 310. An area of the upper surface may be different from an area of the lower surface. The spacer 400 has a through-hole through which the screw 500 is passed between the upper surface and the lower surface. A diameter of the through-hole is smaller than a diameter of the head of the screw 500 and is larger than the diameter of the axis of the screw 500. The diameter of the through-hole of the spacer 400 is preferably equal to the diameter of the through-hole of the bracket 200.

The screw 500 is passed through the through-hole of the spacer 400, the through-hole of the diaphragm 310 of the vibration actuator 300, and the through-hole of the body 210 of the bracket 200, in this order, and is fastened to the screw hole of the screw fixing portion 130. As a result, the spacer 400, the vibration actuator 300, and the bracket 200 are fixed to the display panel 100. Since the screw 500 does not come into contact with the diaphragm 310 and the bracket 200 is an insulator, the display panel 100 is not electrically short-circuited with the diaphragm 310. As a result, even when the diaphragm 310 is not grounded, the voltage is normally applied to the piezoelectric elements 320, 330. A volt and nut may be used instead of the screw 500.

The back chassis 600 is a part of components that cover the back surface of the display panel 100. The back chassis 600 is a planar member that exists on a back side of the vibration actuator 300. The back chassis 600 is, for example, a conductor, such as a metal. The back chassis 600 is supported by the display panel 100, and the like. The back chassis 600 has a protrusion that protrudes toward the vibration actuator 300 in a central portion of the back chassis 600. The protrusion is a pushed out portion pushed out toward the vibration actuator 300. The central portion of the back chassis 600 faces the head of the screw 500. Since the back chassis 600 has the protrusion, a distance between the central portion of the vibration actuator 300 and the back chassis 600 (a distance A in FIG. 1) is shorter than a distance between an end of the vibration actuator 300 and the back chassis 600 (a distance B in FIG. 1). The distance between the central portion of the vibration actuator 300 and the back chassis 600 is shorter than a distance between other portions other than the central portion of the vibration actuator 300 and the back chassis 600. When an external force is applied to the display panel 100 toward a back side of the display panel 100, the screw 500 abuts on the protrusion of the back chassis 600. As a result, the display panel 100 is prevented from being further pushed into the back side of the display panel 100. Furthermore, since the distance A is shorter than the distance B, even when the screw 500 abuts on the protrusion of the back chassis 600 and the vibration actuator 300 vibrates, it is possible to reduce contact between the end of the vibration actuator 300 and the back chassis 600. If the end of the vibration actuator 300 comes into contact with the back chassis 600, the vibration actuator 300 is electrically short-circuited with the back chassis 600 so as to influence the output of the sound. Since the screw 500 is electrically insulated from the vibration actuator 300, even when the screw 500 abuts on the back chassis 600, the vibration actuator 300 is not electrically short-circuited with the back chassis 600.

Second Configuration Example

Here, a second configuration example will be described. The second configuration example has some common points with the first configuration example. Here, the difference between the first configuration example and the second configuration example will be mainly described.

Figure 2:
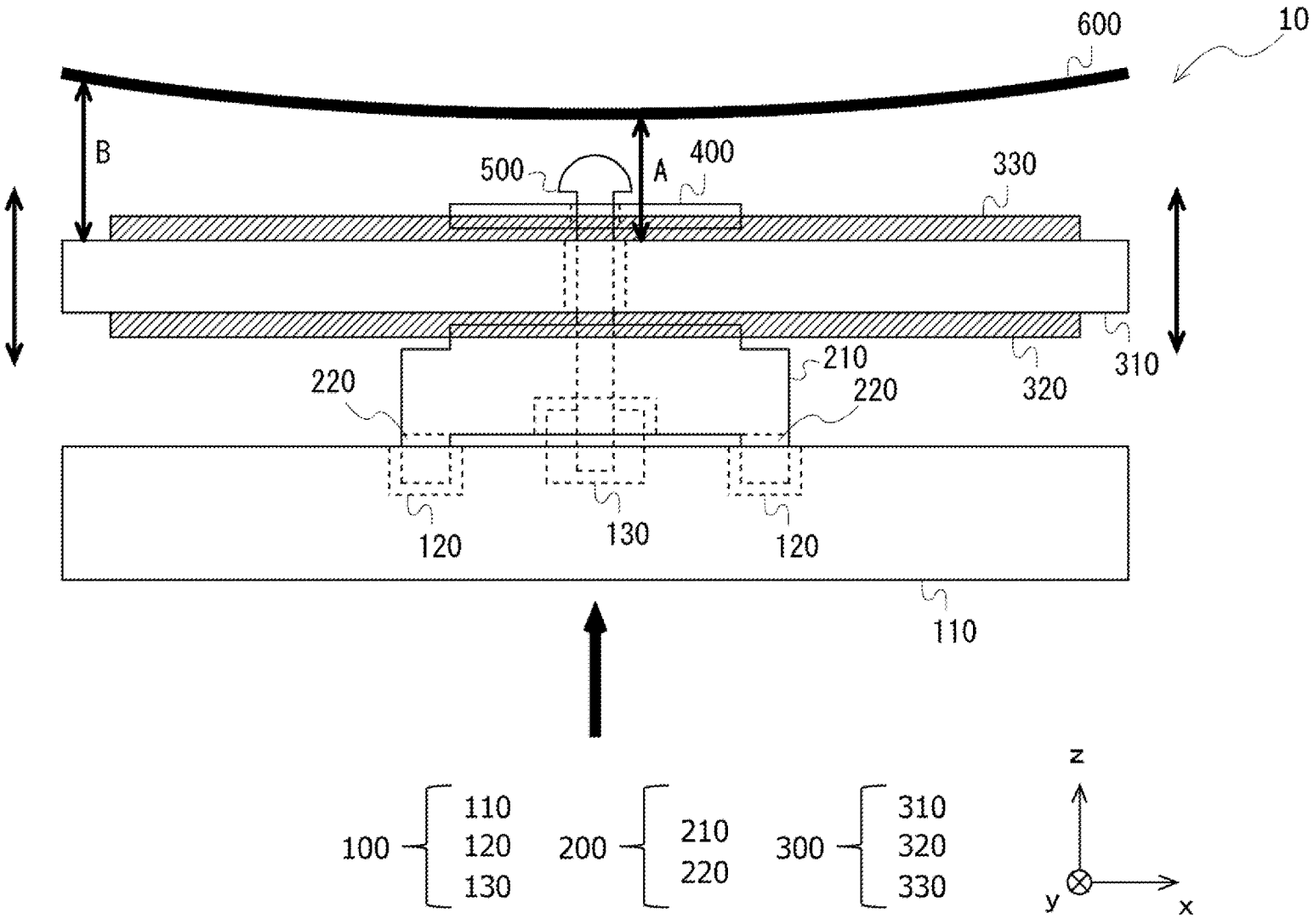
FIG. 2 illustrates a second configuration example of the display speaker 10 according to the embodiment.

FIG. 2 illustrates the second configuration example of a display speaker 10 according to the embodiment. FIG. 2 is a side view when viewed from a side the display speaker 10. The display speaker 10 includes a display panel 100, a bracket 200, a vibration actuator 300, a spacer 400, a screw 500, and a back chassis 600. The back chassis 600 of the second configuration example is different from the back chassis 600 of the first configuration example.

The back chassis 600 of the second configuration example has a bending surface curved toward the vibration actuator 300. The bending surface is one example of a curved portion. The curved portion is one example of a protrusion. A distance between the back chassis 600 and the vibration actuator 300 is the shortest in a central portion of the vibration actuator 300 and is longer toward an end of the vibration actuator 300. Since the back chassis 600 has the bending surface, a distance between the central portion of the vibration actuator 300 and the back chassis 600 (a distance A in FIG. 2) is shorter than a distance between the end of the vibration actuator 300 and the back chassis 600 (a distance B in FIG. 2). Furthermore, when an external force is applied to the display panel 100 toward a back side of the display panel 100, the screw 500 abuts on a central portion of the back chassis 600. As a result, the display panel 100 is prevented from being further pushed into the back side of the display panel 100. Furthermore, since the distance A is shorter than the distance B, even when the screw 500 abuts on the central portion of the back chassis 600 and the vibration actuator 300 vibrates, it is possible to reduce contact between the end of the vibration actuator 300 and the back chassis 600.

Third Configuration Example

Here, a third configuration example will be described. The third configuration example has some common points with the first configuration example. Here, the difference between the first configuration example and the third configuration example will be mainly described.

Figure 3:
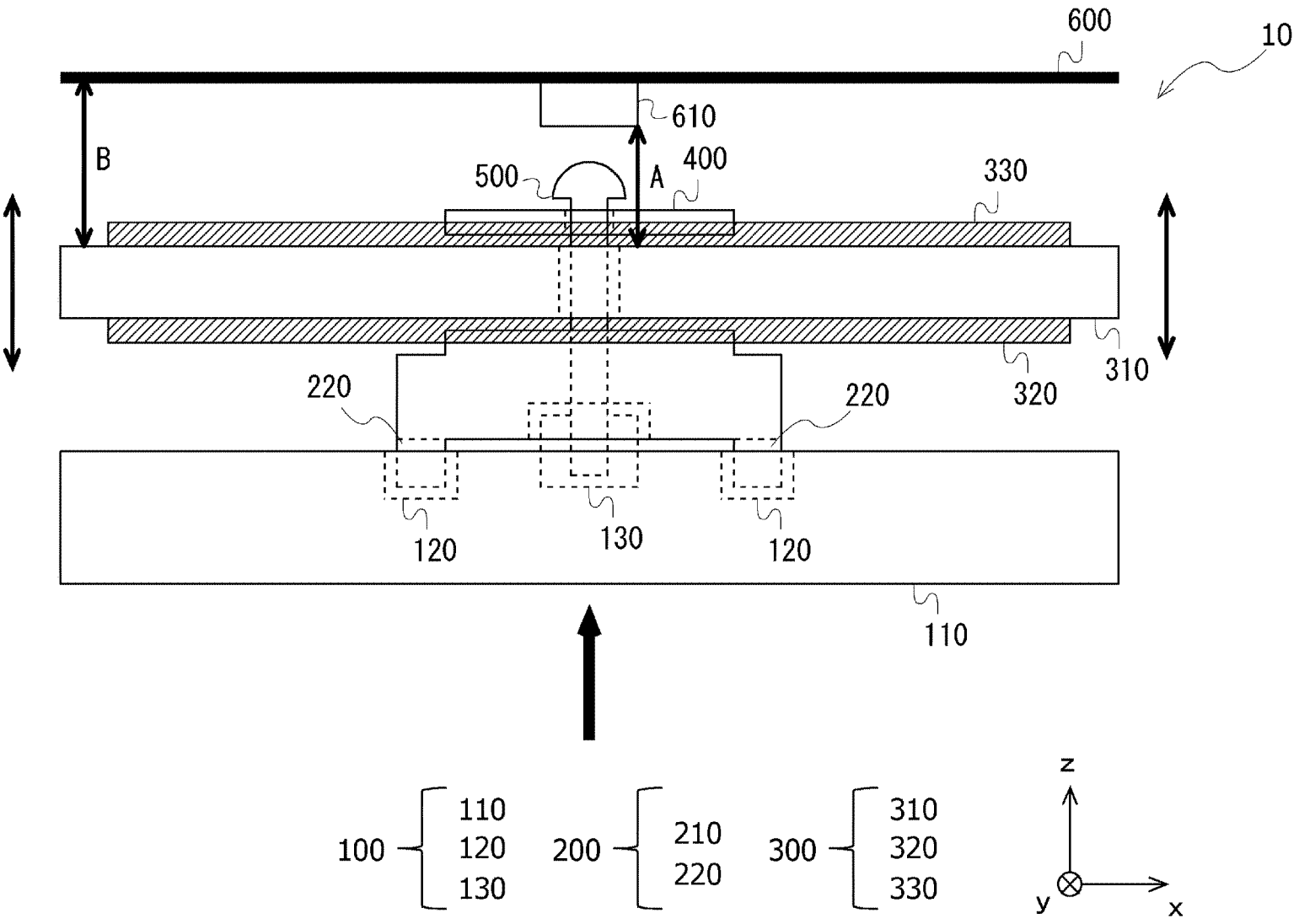
FIG. 3 illustrates a third configuration example of the display speaker 10 according to the embodiment.

FIG. 3 illustrates the third configuration example of a display speaker 10 according to the embodiment. FIG. 3 is a side view when viewed from a side of the display speaker 10. The display speaker 10 includes a display panel 100, a bracket 200, a vibration actuator 300, a spacer 400, a screw 500, and a back chassis 600. The back chassis 600 of the third configuration example is different from the back chassis 600 of the first configuration example.

The back chassis 600 of the third configuration example has a surface parallel to the display panel 100 and a spacer 610 to be provided in a central portion of the surface on a side of the vibration actuator 300. Since the back chassis 600 has the spacer 610, a distance between a central portion of the vibration actuator 300 and the back chassis 600 (a distance A in FIG. 3) is shorter than a distance between an end of the vibration actuator 300 and the back chassis 600 (a distance B in FIG. 3). When an external force is applied to the display panel 100 toward a back side of the display panel 100, the screw 500 abuts on the spacer 610 of the back chassis 600. As a result, the display panel 100 is prevented from being further pushed into the back side of the display panel 100. Furthermore, since the distance A is shorter than the distance B, even when the screw 500 abuts on the spacer 610 of the back chassis 600 and the vibration actuator 300 vibrates, it is possible to reduce contact between the end of the vibration actuator 300 and the back chassis 600. The spacer 610 is, for example, an insulator. Since the spacer 610 is an insulator, when the screw 500 abuts on the spacer 610, even if the screw 500 is electrically short-circuited with the vibration actuator 300, the vibration actuator 300 is not electrically short-circuited with the back chassis 600. The spacer 610 may be used in the first configuration example and the second configuration example.

Function and Effect of the Embodiment

The display speaker 10 according to the embodiment includes the display panel 100, the bracket 200, the vibration actuator 300, the spacer 400, the screw 500, and the back chassis 600. The vibration actuator 300 includes the diaphragm 310, the piezoelectric element 320, and the piezoelectric element 330. The bracket 200, the vibration actuator 300, and the spacer 400 are fixed to the display panel 100 by the screw 500. The screw 500 is passed through the through-hole of the bracket 200, the through-hole of the vibration actuator 300, and the through-hole of the spacer 400. The back chassis 600 is shaped so that the distance between the central portion of the vibration actuator 300 and the back chassis 600 (the shortest distance) is shorter than the distance between the end of the vibration actuator 300 and the back chassis 600 (the shortest distance). As a result, when an external force is applied to the display panel 100 toward the back side of the display panel 100, the screw 500 abuts on the spacer 610 of the back chassis 600. Thus, the display panel 100 is prevented from being further pushed into the back side of the display panel 100. Furthermore, when the screw 500 abuts on the back chassis 600, even when the vibration actuator 300 vibrates, it is possible to reduce the contact between the end of the vibration actuator 300 and the back chassis 600. By preventing the end of the vibration actuator 300 from coming into contact with the back chassis 600, the display speaker 10 can output a high quality sound.

Although the embodiment of the invention has been described above, the embodiment is merely an example, and the invention is not limited to the above embodiment. Various modifications (such as a combination of the above configurations) may be made by those skilled in the art without departing from the invention as defined in the following claims.

While the invention has been shown and described in detail, the foregoing description is in all aspects illustrative and not restrictive. It is therefore understood that numerous other modifications and variations can be devised without departing from the scope of the invention.

What is claimed is:

1. A panel speaker comprising:

a panel;

a vibration actuator having first and second oppositely-facing surfaces, the first surface facing the panel;

a screw that fastens the vibration actuator to the panel, the screw having a head that protrudes beyond the second surface of the vibration actuator; and a back chassis that faces the second surface of the vibration actuator, wherein the back chassis has a protrusion protruding in a front-rear direction of the panel speaker toward the vibration actuator in a portion of the back chassis that faces the head of the screw, and a distance between the protrusion and the head of the screw in the front-rear direction of the panel speaker is greater than zero so that a gap exists between the protrusion and the head of the screw in the front-rear direction of the panel speaker.

2. The panel speaker according to claim 1, wherein the protrusion is a pushed out portion of the back chassis pushed out toward the vibration actuator.

3. The panel speaker according to claim 1, wherein the protrusion is a curved portion of the back chassis curved toward the vibration actuator.

4. The panel speaker according to claim 1, wherein the protrusion is a spacer provided on a surface of the back chassis that faces the second surface of the vibration actuator.

5. The panel speaker according to claim 1, wherein the screw is electrically insulated from the vibration actuator.

6. The panel speaker according to claim 4, wherein the spacer is an insulator.

7. The panel speaker according to claim 1, wherein the distance between the protrusion and the head of the screw in the front-rear direction of the panel speaker is a first non-zero distance, a distance between the protrusion and the second surface of the vibration actuator in the front-rear direction of the panel speaker is a second non-zero distance, and the first non-zero distance is less than the second non-zero distance so that when a force is applied between the panel and the back chassis, the protrusion contacts the head of the screw without the protrusion contacting the second surface of the vibration actuator.

* * * * *